United States Patent [19]

Uenoyama et al.

[11] Patent Number: 4,670,202

[45] Date of Patent: Jun. 2, 1987

[54] METHOD AND APPARATUS FOR MELT SPINNING

[75] Inventors: Yoshio Uenoyama; Kiyoshi Takazawa; Takayuki Izumi, all of Saitama, Japan

[73] Assignee: Toa Nenryo Kogyo Kabushiki Kaisha, Tokyo, Japan

[21] Appl. No.: 581,765

[22] Filed: Feb. 21, 1984

[30] Foreign Application Priority Data

Feb. 24, 1983 [JP] Japan ..... 58-28576

[51] Int. Cl.[4] ..... B29C 47/88; D01D 5/084

[52] U.S. Cl. ..... 264/39; 264/85; 264/169; 423/447.6; 423/447.7; 425/72 S; 425/378 S

[58] Field of Search ..... 264/169, 39, 29.2, 85, 264/29.5–29.7; 425/72 S, 378 F; 423/447.7, 447.6

[56] References Cited

U.S. PATENT DOCUMENTS

| | | | |
|---|---|---|---|
| 3,447,202 | 6/1969 | Kato | 425/72 S |
| 3,502,757 | 3/1970 | Spencer | 264/169 |
| 3,585,684 | 6/1971 | McIntosh et al. | 425/378 S |
| 3,814,559 | 6/1974 | Akers et al. | 425/72 S |
| 3,847,522 | 11/1974 | Heckrotte et al. | 425/72 S |
| 4,017,327 | 4/1977 | Lewis et al. | 264/29.1 |
| 4,301,135 | 11/1981 | Nazem et al. | 423/447.6 |
| 4,351,816 | 9/1982 | Schulz | 264/29.7 |

FOREIGN PATENT DOCUMENTS

| | | | |
|---|---|---|---|
| 47-00090 | 1/1972 | Japan | 425/72 S |
| 52-8116 | 1/1977 | Japan | 264/169 |
| 52-34017 | 3/1977 | Japan | 264/169 |
| 52-34016 | 3/1977 | Japan | 264/169 |
| 58-115112 | 7/1983 | Japan | 264/169 |
| 654701 | 3/1979 | U.S.S.R. | 264/169 |

*Primary Examiner*—Jeffery Thurlow

*Attorney, Agent, or Firm*—Jordan and Hamburg

[57] ABSTRACT

In a melt spinning operation, a heated wash gas such as nitrogen or nitrogen and air is blown across the melt spinning nozzles to remove volatiles thereby preventing wetting of the nozzle discharge. The wash gas is maintained at a temperature substantially equal to the melt spinning temperature. The preferred melt spinning material is petroleum pitch.

5 Claims, 1 Drawing Figure

METHOD AND APPARATUS FOR MELT SPINNING

BACKGROUND OF THE INVENTION

The present invention relates to a method and apparatus for melt spinning, and more particularly, to a method and apparatus for melt spinning which is effective in the spinning of pitch carbon fibers.

In melt spinning, particularly high-temperature melt spinning, such as the spinning of pitch carbon fibers, a volatile low-molecular gas, e.g., oil smoke (of the heavy hydrocarbon component) is generated from the spinneret and the spun filaments to cause "wetting", that is, the generated volatile low-molecular gas adheres to the surfaces of the spinneret plate and various members in the vicinity of the spinneret plate, such as the heating tube, and contaminates the spinneret plate, the heating tube, etc. This wetting results in oscillation of the spun filaments, causing fusion of the spun filaments or unevennesses in denier, or even the breakage of the filaments in the worst case, which makes it impossible to effect stable spinning over a long period of time.

In order to prevent this wettin in melt spinning, methods have hitherto been proposed such as sucking away the gases in the vicinity of the spinneret plate, or forcibly blowing cooling gas onto the surface of the spinneret plate. It has, however, been found that stable spinning cannot be effected by these conventional methods in high-temperature melt spinning, such as the spinning of pitch carbon fiber.

SUMMARY OF THE INVENTION

In view of this disadvantage of conventional methods, the inventors of the present invention have found, as the result of extensive research and experimentation, that in high-temperature melt spinning it is necessary to maintain the spinneret plate surface and the atmosphere thereof at high temperatures, and that in a spinneret plate which has a plurality of spinning nozzles annularly disposed around its outer periphery, blowing a high-temperature wash gas onto the spinneret plate, from the center toward the outer periphery thereof, makes it possible to prevent "wetting" and eliminate the oscillation of spun filaments, fusion of the filaments, and denier unevenness, thereby enabling stable melt spinning over a long period of time. Thus, the present invention has been accomplished on the basis of such novel knowledge.

Accordingly, it is a primary object of the invention to provide a melt spinning method which makes it possible to prevent "wetting" of the spinneret plate, i.e., the contamination of the spinneret plate surface, to effect stable melt spinning over a long period of time, and an apparatus for carrying out this method.

It is another object to provide a melt spinning apparatus which is simple in structure and extremely efficient.

To these ends, the present invention provides a method of melt spinning comprising the step of blowing a wash gas of a temperature slightly lower than the spinning temperature onto the outlet surface of a spinneret plate used in melt spinning. In a spinneret plate with spinning nozzles arranged around its outer periphery, such as spinneret plate for petroleum pitch carbon fibers, the wash gas is blown on the spinneret plate from the central part toward the outer peripheral part thereof. When melt spinning petroleum pitch, the wash gas is preferably an inert gas, such as nitrogen, or a mixture of nitrogen and air, while the temperature of the wash gas is preferably between 280° to 320° C., and the flow rate of the gas is preferably between 0.5 to 1.5/minute.

DESCRIPTION OF THE PREFERRED EMBODIMENTS

Figure 1:
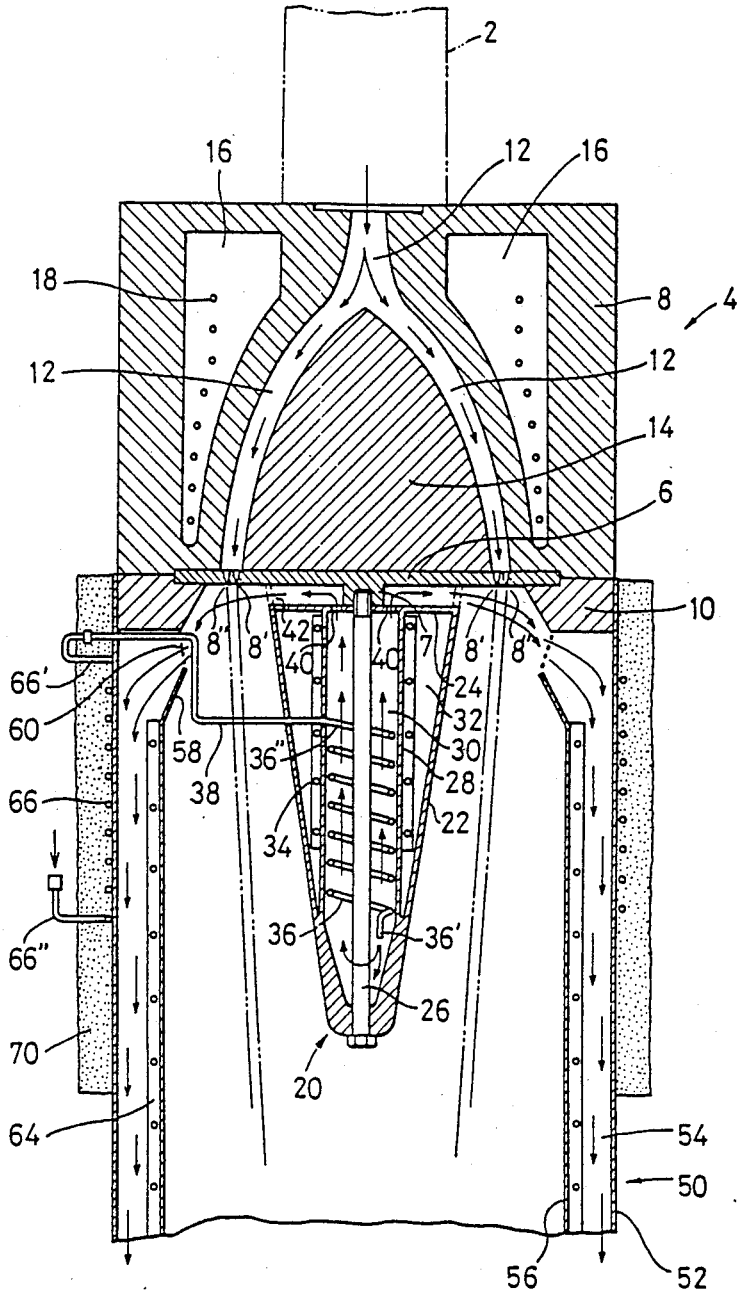
FIG. 1 is a schematic longitudinally sectioned view of an embodiment of the spinning apparatus in accordance with the invention.

An embodiment of the apparatus for carrying out the melt spinning method in accordance with the invention will be described hereinunder.

FIG. 1 schematically shows a melt spinning apparatus 1 for the usual melt spinning of petroleum pitch carbon. The melt spinning apparatus 1 has a melt-spinning head structure 4 connected to an extruder (not shown) by a connection pipe 2. The melt-spinning head structure 4 has a nozzle head 8 which consists of a die connected to the connection pipe 2 so as to receive molten spinning material supplied from the extruder, and guide the molten spinning material to a spinneret plate 6. The spinneret plate 6 has spinning nozzles (8', 8'') annularly arranged around its outer periphery. In this embodiment, the spinning nozzles are shown as two rows of circumferential nozzles which are arranged circumferentially in two circles. The spinneret plate 6 is attached to the lower surface of the nozzle head 8 by a spinneret plate holder 10. The spinneret plate holder 10 is detachably secured to the nozzle head 8 by bolts (not shown). The nozzle head 8 has therein passage 12 for guiding the molten spinning material to the nozzles 8' and 8'' in the spinneret plate 6. This passage 12 can be defined by a chamber formed in the nozzle head 8 and a mandrel 14 within the chamber. In this embodiment, the mandrel 14 has a substantially conical configuration and is securred to the spinneret plate 6 by bolts (not shown). The nozzle head 8 has a heating chamber 16 therein which is formed so as to substantially surround the passage 12. A heating means 18, e.g., an electric heater, is provided in the heating chamber 16. The heating means 18 keeps the molten spinning material flowing through the passage 12 at a predetermined temperature.

The melt-spinning head structure 4 also has an inner heating tube 20 and an outer heating tube 50 which are connected to the nozzle head 8 and positioned on the outlet side of the spinneret plate 6.

The inner heating tube 20 has an outer wall 22 which is preferably formed in a substantially inverted cone shape. A base wall 24 of the inner heating tube 20 is attached to a pedestal 7 formed at the center of the spinneret plate 6 by a through-bolt 26. The interior of the inner heating tube 20 is divided by a central annular partition wall 28 into a central chamber 30 and an annular chamber 32 surrounding it. A heating means 34 such as an electric heater is provided in the annular chamber 32, and a wash gas pipe 36 is spirally arranged in the central chamber 30. The lower end 36' of the wash gas pipe 36 opens into the lower part of the central chamber 30, while the upper end 36'' of the wash gas pipe 36 is connected to one end of a connection pipe 38 extending through the central annular partition wall 28 and the outer wall 22 of the inner heating tube 20 to the outside. The base wall24 of the inner heating tube 20, which defines part of the central chamber 30, is provided with a plurality of holes 40.

A cylindrical filter 42 is positioned between the outermost periphery of the base wall 24 of the inner heating tube and the spinneret plate 6. The filter 42 serves to guide the hot gas for the washing uniformly to the outer periphery of the spinneret plate 6, and therefore may be made of a sintered alloy or of wire mesh. It is preferable to employ a filter of SUS-304 and between #90 to #300 mesh (about 150 to 50).

The outer heating tube 50 surrounding the inner heating tube 20 has, for example, an outer housing 52 attached to the outer periphery of the spinneret plate holder 10, and an inner housing 56 which is mounted within the outer housing 52 concentrically therewith so as to define an annular wash gas discharge passage 54 together with the outer housing 52. The upper end 58 of the inner housing 56 is bent slightly inward so that an opening 60 for the discharge passage 54 is defined between the edge of the upper end 58 and the lower surface of the spinneret plate holder 10. Wire mesh or a punched metal sheet may be provided in the opening 60.

The inner housing 56 has a heating means 64 such as an electric heater attached to the side thereof which defines the discharge passage 54. The heating means 64 heats the outer heating tube 50.

A wash gas pipe 66 is wound spirally around the upper part of the outer housing 52. The upper end 66 of the wash gas pipe 66 is connected to the other end of the connection pipe 38, and the lower end 66″ of the wash gas pipe 66 is connected to a wash gas supply source (not shown). In addition, it is preferable to provide a member 70, made on material similar to ceramic fibers, over the upper part of the outer housing 52 around which the wash gas pipe 66 is wound.

The operation of the melt spinning apparatus 4 will be explained hereinunder.

The spinning material melted by the extruder is supplied to the nozzle head 8 through the connection pipe 2. The nozzle head 8 has been previously heated by the heating means, 18, so the molten spinning material is supplied to the spinneret plate 6 at a desired temperature and is spun from the spinning nozzles 8′ and 8″. When melt spinning petroleum pitch, the molten pitch is heated to about 320° C.

The inner heating tube 20 and the outer heating tube 50 are heated by the heating means 34 and 64, respectively, so that the temperature of the atmosphere below the spinneret plate 6 is about 20° to 80° C. lower than the spinning temperature. Accordingly, when melt spinning petroleum pitch, the inner and outer tubes are heated so that the temperatures of their surfaces are between 200° to 260° C.

A wash gas is supplied to one end 66″ of the wash gas pipe 66. When melt spinning petroleum pitch it is preferable to employ as the wash gas an inert gas, such as nitrogen, or a relatively inert gas, such as a mixture of nitrogen and air. As it flows through the wash gas pipe 66, the wash gas is preheated to a predetermined temperature, for example about 200° C. for the melt spinning of petroleum pitch carbon fibers. The wash gas is then supplied through the connection pipe 38 to the wash gas pipe 36 in the inner heating tube 20. The wash gas is further heated to the desired temperature in the inner heating tube 20 and is discharged into the lower part of the central chamber 30 of the inner heating tube 20. The wash gas then rises from the lower part to the upper part of the central chamber 30 while being further heated, and is blown onto the center of the surface of the outlet side of the spinneret plate 6 from the holes 40 formed in the base wall 24 of the inner heating tube 20. The temperature of the wash gas at this point is set so as to be substantially equal to the spinning temperature. When melt spinning petroleum pitch, the temperature of the wash gas at this point is preferably about 280° to 320° C. The flow rate of the wash gas is preferable between about 0.5 to 1.5 liters/minute, although this can vary according to the number, size, etc., of the filaments discharged from the spinning nozzles.

The high-temperature wash gas blown onto the center of the surface of the outlet side of the spinneret plate 6 flows radially along the surface of the spinneret plate 6 toward the outer periphery thereof. The wash gas passes through the filter 42 and continues to flow along the surface of the spinneret plate 6 toward the outer periphery thereof. The filter 42 acts to disperse the wash gas uniformly along the spinneret plate surface. When it passes the region of the spinning nozzles 8′ and 8″, the wash gas entrains any oil smoke (the heavy hydrocarbon component) generated in the vicinity of the spinning nozzles 8′ and 8″. The wash gas flows into the discharge passage 54 in the outer heating tube 50 from the outer periphery of the spinneret plate 6, and is discharged outside. The high-temperature wash gas flowing through the discharge passage 54 is used to preheat the wash gas in the wash gas pipe 66 provided around the outer periphery of the outer heating tube 50.

By thus allowing the high-temperature gas to flow along the surface of the outlet side of the spinneret plate, any oil smoke on the spinneret plate surface is forcibly discharged. In consequence, the quantity of oil smode adhering to the spinneret plate surface is greatly reduced, thereby enabling a large improvement concerning the "wetting" of the spinneret plate surface. According to the spinning method and apparatus in accordance with the present invention, when the method and apparatus of the present invention is applied to the melt spinning of petroleum pitch carbon fibers, the maximum continuous spinning time can be extended to more than 500 hours from 40 hours, which is the conventional maximum time.

The temperatures of both the inner heating tube 20 and the outer heating tube 50 are controlled by a temperature controller (not shown) so as to keep the temperature of the spinning atmosphere constant. The functions of the inner and outer heating tubes 20, 50, together with the action of the high-temperature wash gas preventing cooling of the lower surface of the spinning nozzles, and heating and keeping warm the spinneret plate to improve its spinning properties, uniformly heat the spun filaments, such as multifilaments, and prevent the multifilaments from solidifying directly below the spinning nozzles, thereby obtaining smooth drawing thereof. Accordingly, even at the start of spinning, the filaments can be prevented from bending, so that it is possible to greatly reduce the possibility that the filaments come into contact with each other in the vicinity of the spinneret plate. Thus, the preliminary spinning time, from the start of spinning to a stable spinning state, can be reduced to less than five minutes from the ten minutes which is the conventional preliminary spinning time. In the actual melt spinning of petroleum pitch carbon fibers, bending of the multifilaments one meter directly below the spinning nozzles, under conditions in which the multifilaments gravity-drop after being spun without being wound, is reduced to between 20 to 30 mm from the conventional 100 to 150 mm, since the installation of the inner and outer heating tubes means that the temperature of the spinning atmosphere can be made uniform. Thus, the present invention provides excellent spinning properties and makes it possible to effect spinning with spinning nozzles in arranged in a number of rows increased from one to two or more, so that the output can be doubled.

What is claimed:

1. An apparatus for melt spinning comprising
(a) a spinneret plate having a plurality of circumferentially spaced spinning nozzles formed therein and arranged in a circle therein;
(b) an inner tube depending from a central portion of the nozzle plate, said tube being closed at its lower end and having an opening in its upper end;
(c) means for heating the inner tube;
(d) an outer tube depending from the nozzle plate at a circumferential location and outside the nozzle circle and having an opening in its upper end;
(e) an outer housing surrounding said outer tube and therewith defining an annular passage;
(f) means for heating the outer tube; and
(g) a tubing extending around said housing into the inner tube, spirally down said inner tube, said lower end of said tubing in said inner tube being open, whereby wash gas piped through the tubing flows around the annular passage into and down said inner tube, up said inner tube across the lower surface of the nozzle plate discharging through the annular passage.

2. The apparatus as defined in claim 1 and further comprising means for extruding petroleum pitch through said spinning nozzles.

3. The apparatus as defined in claim 1 wherein the means for heating said inner tube includes heating elements positioned around said inner tube.

4. A method of melt spinning comprising
(a) melt spinning molten petroleum pitch into fibers through a plurality of circumferentially spaced nozzles arranged in a circle on a spinneret plate and surrounded by a circumferential annular passage;
(b) introducing wash gas through said annular passage into a central location within said circumferential nozzles and discharging the wash gas from said central location radially outwardly across the lower surface of the spinneret plate at a rate of at least 0.5 liters per minute, said wash gas having a temperature substantially equal to the spinning temperature to forcibly remove volatiles from the discharge of the nozzles thereby preventing wetting thereabout;
(c) removing the wash gas and volatiles through said circumferential annular passage radially outwardly of the nozzles; and
(d) passing substantially all of the removed wash gas in said annular passage in the direction of fiber formation and in heat exchange relation with said wash gas prior to introduction into said central location.

5. The method as defined in claim 4 wherein the wash gas is fed at a rate of between 0.5 and 1.5 liters per minute.

* * * * *